US011585340B2

(12) United States Patent
Rawlings et al.

(10) Patent No.: US 11,585,340 B2
(45) Date of Patent: Feb. 21, 2023

(54) MULTI-CHANNEL POSITIVE DISPLACEMENT PUMP APPARATUS

(71) Applicant: Fluid Metering, Inc., Syosset, NY (US)

(72) Inventors: David Lionel Rawlings, Sound Beach, NY (US); Francis Dongil Suh, Kings Park, NY (US); Zachary James Beauman, Westbury, NY (US)

(73) Assignee: Fluid Metering, Inc., Syosset, NY (US)

( * ) Notice: Subject to any disclaimer, the term of this patent is extended or adjusted under 35 U.S.C. 154(b) by 19 days.

(21) Appl. No.: 16/966,738

(22) PCT Filed: Feb. 1, 2019

(86) PCT No.: PCT/US2019/016319
§ 371 (c)(1),
(2) Date: Jul. 31, 2020

(87) PCT Pub. No.: WO2019/152824
PCT Pub. Date: Aug. 8, 2019

(65) Prior Publication Data

US 2020/0362854 A1 Nov. 19, 2020

Related U.S. Application Data

(60) Provisional application No. 62/625,687, filed on Feb. 2, 2018.

(51) Int. Cl.
*F04B 53/14* (2006.01)
*F04B 53/16* (2006.01)
(Continued)

(52) U.S. Cl.
CPC ..... *F04B 53/14* (2013.01); *F04B 23/06* (2013.01); *F04B 7/0046* (2013.01);
(Continued)

(58) Field of Classification Search
CPC ..... F04B 53/14; F04B 23/06; F04B 53/16; F04B 7/0046; F04B 7/0053; F04B 7/06;
(Continued)

(56) References Cited

U.S. PATENT DOCUMENTS 1,857,922 A * 5/1932 Lewis ..... F04B 1/00 417/419
3,363,571 A 1/1968 Reynolds et al.
(Continued)

FOREIGN PATENT DOCUMENTS

DE 19528618 A1 * 2/1997 ..... F04B 7/06
EP 0586280 A1 * 3/1994 ..... F04B 7/06
(Continued)

OTHER PUBLICATIONS

DE19528618 translation (Year: 2021).*

*Primary Examiner* — Kenneth J Hansen
*Assistant Examiner* — David N Brandt
(74) *Attorney, Agent, or Firm* — Hoffmann & Baron, LLP

(57) ABSTRACT

A multi-channel positive displacement piston pump apparatus includes a motor and a plurality of positive displacement piston pumps driven by the motor. The plurality of pumps are aligned in a stacking direction, and each pump has an intake port and an outlet port, wherein the intake ports and the outlet ports of all pumps face in the same direction generally perpendicular to the stacking direction. In a method for retrofitting a positive displacement piston pump for use in a multi-channel pumping apparatus, an outlet port of a pump housing of the pump and a flush outlet port of the pump housing are plugged and an alternative fluid path is formed within the pump housing. The outlet port is disposed in line with an inlet port of the pump housing but on an opposite side of the pump housing. The flush outlet port is disposed in line with a flush inlet port of the pump housing but on an opposite side of the pump housing. In this way, the
(Continued)

alternative fluid path is formed between the inlet port and the flush inlet port.

6 Claims, 12 Drawing Sheets

(51) Int. Cl.

| | |
|---|---|
| ***F04B 23/06*** | (2006.01) |
| ***F04B 7/06*** | (2006.01) |
| ***F04B 53/22*** | (2006.01) |
| ***F04B 9/04*** | (2006.01) |
| ***F04B 13/02*** | (2006.01) |
| ***F04B 7/00*** | (2006.01) |

(52) U.S. Cl.
CPC ..... *F04B 7/0053* (2013.01); *F04B 7/06* (2013.01); *F04B 9/04* (2013.01); *F04B 13/02* (2013.01); *F04B 53/166* (2013.01); *F04B 53/22* (2013.01)

(58) Field of Classification Search
CPC .... F04B 9/02; F04B 9/04; F04B 13/02; F04B 53/162; F04B 53/166; F04B 53/22
See application file for complete search history.

(56) References Cited

U.S. PATENT DOCUMENTS

| | | | | |
|---|---|---|---|---|
| 4,712,578 | A | 12/1987 | White | |
| 5,035,585 | A * | 7/1991 | Berges | F04C 23/001 417/423.5 |
| 5,698,849 | A | 12/1997 | Figueria, Jr. | |
| 7,708,535 | B2 * | 5/2010 | Peeler | F04B 49/12 417/500 |
| 2002/0057970 | A1 * | 5/2002 | Amsler | G01F 11/029 417/500 |
| 2007/0256556 | A1 * | 11/2007 | Rawlings | F16J 15/324 92/165 R |
| 2010/0140302 | A1 | 6/2010 | Knobel | |
| 2015/0177034 | A1 * | 6/2015 | Alekseyev | G01F 3/10 73/861.08 |
| 2017/0218950 | A1 * | 8/2017 | Mizukoshi | F04B 53/162 |
| 2019/0326906 | A1 * | 10/2019 | Camacho Cardenas | H03K 17/945 |

FOREIGN PATENT DOCUMENTS

| | | |
|---|---|---|
| WO | 2007/119149 A2 | 10/2007 |
| WO | 2016/132097 A1 | 8/2016 |

* cited by examiner

MULTI-CHANNEL POSITIVE DISPLACEMENT PUMP APPARATUS

CROSS-REFERENCE TO RELATED APPLICATION

This application claims the benefit of U.S. Provisional Application No. 62/625,687, filed Feb. 2, 2018, which is incorporated herein by reference in its entirety for all purposes.

BACKGROUND OF THE INVENTION

The present invention relates generally to liquid pumping systems, wherein one liquid is pumped or fed into the stream of another liquid. More particularly, the present invention relates to an apparatus that couples multiple pump heads to one driving motor, while utilizing a new ceramic design that allows for inlet and outlet ports to be on the same side of the pump, all while being backwards compatible to legacy instrumentation.

There exists in the medical field, for example, a variety of analytical machines, which are employed for purposes of analyzing sample fluids such as blood and urine obtained from human or animal subjects. Such analyses are typically done to determine if the subject has normal or abnormal physiology, which may suggest the need for additional medical intervention.

These machines typically perform their analyses by mixing small amounts of specified chemicals together with the subject's fluid sample. The fluid sample is typically metered into a suitable container, such as an ampule, the specified chemical is added, and then a variety of tests are conducted on the mixture. Often, the operation of the machine will involve a production line arrangement, wherein a large number of test sample mixtures progress through the dispense, mix and test phases so that a sizable batch of analyses can be performed on an efficient scale. Once the tests on a particular sample have concluded, it becomes necessary to remove the fluid mixture from machine container for disposal. This removed sample/chemical mixture is termed "waste" in the industry. The empty container (ampule) is then appropriately cleaned and reused or discarded.

The task of removing waste fluids in such machines is often handled by some sort of multi-channel pump. Such a pump is most often a positive displacement design such as provided by peristaltic or diaphragm pumps. Multiple channels are created by ganging together individual pumps and either driving the pumps with a single motor, multiple motors or solenoids.

Waste pumps based upon the designs mentioned above suffer from a variety of problems. Peristaltic pumps employ a repeating sequence of flattening and then releasing an elastomeric tube which relies on the elastic memory properties of the tubing material to restore the tube cross section to the non-flattened shape. This sequence of flattening and then relaxing of the tubing is repeated a very large number of times during a typical waste removal cycle. Two problems arise from this cyclical tube stress/strain activity:

1. As the elastomeric tube fatigues, it begins to tire and become less able to restore its round cross-section after being squeezed flat. This necessarily results in a reduction of displaced fluid with each pump rotation. If the pump is being driven at a constant RPM, this tubing degradation results in a lowering of fluid flow through the pump.

2. A second related problem is the inevitability of catastrophic tubing fatigue failure if the tubing is not removed and replaced as part of a strict preventive maintenance protocol. Tubing failure results in waste fluid being discharged from the pump body onto nearby machine parts and then further dripping down out of the machine onto the floor below. Aside from the obvious health and machine contamination effects from tubing failure, the associated interruption of waste removal from the production-line sample analysis can severely impact throughput of the machine.

Diaphragm pumps rely on check valves working in concert with flexing diaphragms to move fluid from the intake to the output ports of the pump. Check valves can be problematic in waste pump applications as they are often a site for contamination entrapment, which can lead to valve malfunction. When this occurs, flow through the pump is interrupted. Additionally, the diaphragm in this style of pump is typically made from an elastomeric material which can suffer from fatigue and ultimate failure. Such diaphragm failure can lead to the same contamination and loss of machine function as described above for peristaltic pumps.

Valveless piston pumps, that make up a third category of positive displacement pumps, have been around for many years. These pumps include a specially designed piston/liner set, wherein a rotating and reciprocating piston has a cutout at the end of the piston in the shape of the letter "D". During the intake stroke, the inlet port of the liner is open and fluid is sucked into the liner and travels down the "D" cut-out on the piston to fill the liner. During the outtake stroke, the inlet port is blocked and fluid is pushed out an outlet port.

However, there are several requirements for a multi-channel waste pump that heretofore made the use of valveless pump technology impractical as a substitute for multi-channel peristaltic and diaphragm pumps. For example, size constraints make it difficult to sufficiently shrink individual pumps to the point where a multi-channel version of the valveless pump could be incorporated into existing legacy equipment. Also, the need to have all inlets and outlets of all channels on one side of the pump is not possible with existing piston pump designs.

Therefore, it would be desirable to provide a multi-channel valveless piston pump that is compatible with legacy equipment in order to allow use in the large quantity of analytical machines presently equipped with peristaltic type waste pumps. Compatibility requirements extend beyond mechanical issues such as size to include electrical (drive and sensor), and fluid connection issues.

SUMMARY OF THE INVENTION

A multi-channel positive displacement piston pump apparatus according to one aspect of the present invention generally includes a motor and a plurality of positive displacement piston pumps driven by said motor. The plurality of pumps are aligned in a stacking direction, and each pump has an intake port and an outlet port, wherein the intake ports and the outlet ports of all pumps face in the same direction generally perpendicular to the stacking direction.

The motor includes a rotatable shaft engaged with a piston of a first of the plurality of pumps. The motor drives at least a second of the plurality of pumps via at least one of a gear arrangement or a pulley arrangement.

Each of the pumps includes a pump housing defining a central longitudinal bore and a pump piston axially and rotatably slidable within the central longitudinal bore for pumping a liquid through the pump housing. The pump housing further includes an inlet port, an outlet port, a first transverse bore communicating with the central longitudinal bore for conveying the liquid from the inlet port to the central longitudinal bore, a second transverse bore communicating with the central longitudinal bore for conveying the liquid from the central longitudinal bore to the outlet port, a longitudinal groove extending between the first transverse bore and the second transverse bore for conveying the liquid therebetween and an annular groove formed in the central longitudinal bore at a juncture of the central longitudinal bore and the second transverse bore for conveying the liquid from the longitudinal groove around the piston to the second transverse bore.

The pump housing preferably includes a pump casing having the inlet port and the outlet port and a liner received within the pump casing, wherein the liner has the central longitudinal bore, the first transverse bore, the second transverse bore, the longitudinal groove and the annular groove. The longitudinal groove can be formed in an outer surface of the liner facing the casing or in an inner surface of the liner defining the central longitudinal bore. The pump casing further preferably includes a first plugged port disposed opposite the inlet port and a second plugged port disposed opposite the outlet port.

In another aspect of the present invention, a method for retrofitting a positive displacement piston pump for use in a multi-channel pumping apparatus is provided. The method generally includes plugging an outlet port of a pump housing of the pump, plugging a flush outlet port of the pump housing and forming an alternative fluid path within the pump housing. The outlet port is disposed in line with an inlet port of the pump housing but on an opposite side of the pump housing. The flush outlet port is disposed in line with a flush inlet port of the pump housing but on an opposite side of the pump housing. In this way, the alternative fluid path is formed between the inlet port and the flush inlet port.

The alternative fluid path is defined by a longitudinal groove extending between a first transverse bore and a second transverse bore of the pump housing and an annular groove formed in a central longitudinal bore of the pump housing at a juncture between the central longitudinal bore and the second transverse bore.

In the method according to this aspect of the invention, the pump housing preferably includes a pump casing having the inlet port and the outlet port and a liner received within the pump casing. The liner has the central longitudinal bore, the first transverse bore, the second transverse bore, the longitudinal groove and the annular groove. The longitudinal groove can be formed in an outer surface of the liner facing the casing or in an inner surface of the liner defining the central longitudinal bore.

The preferred embodiments of the apparatus and method of the present invention, as well as other objects, features and advantages of this invention will be apparent from the following detailed description, which is to be read in conjunction with the accompanying drawings.

DETAILED DESCRIPTION OF THE PREFERRED EMBODIMENTS

Figure 1:
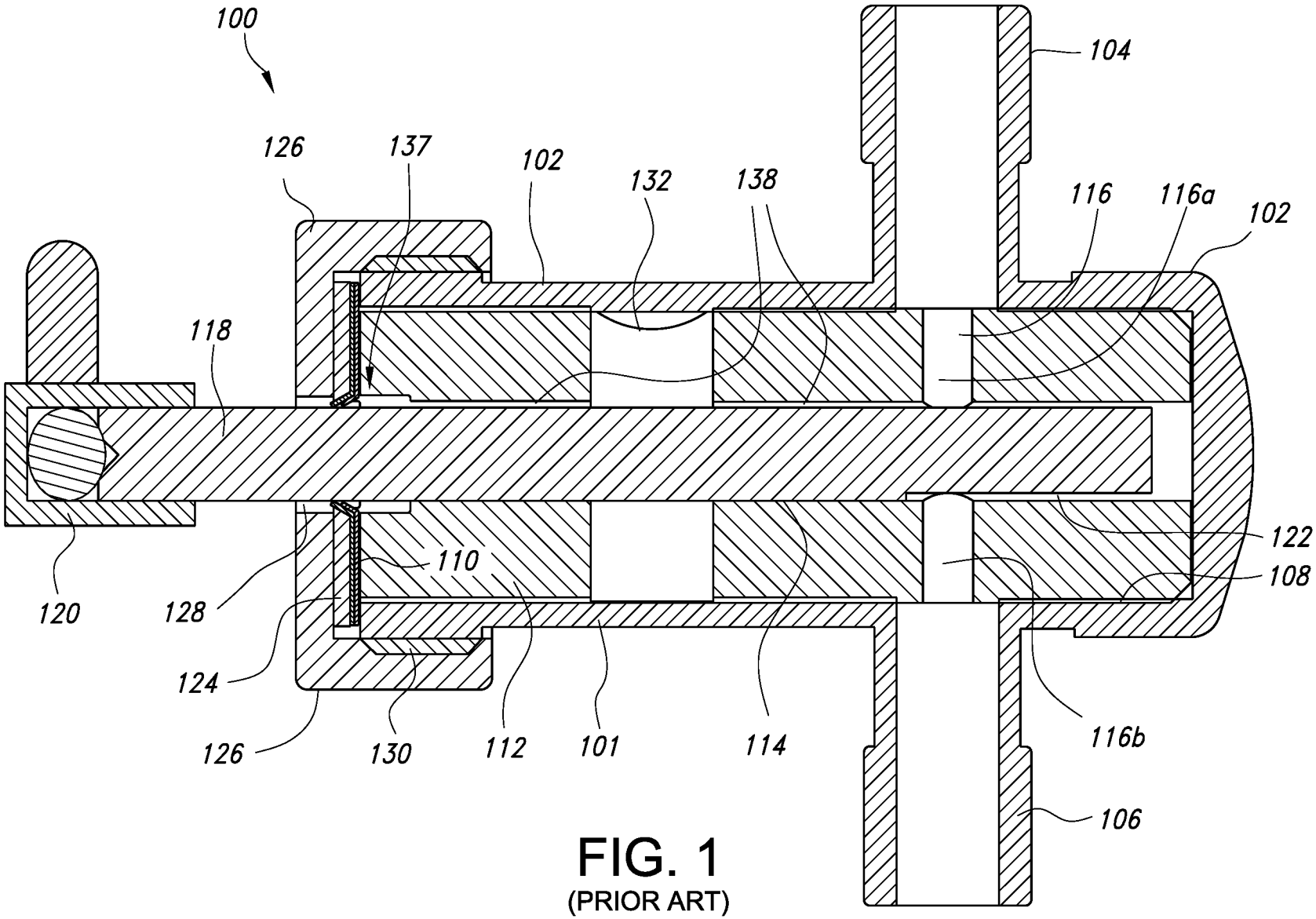
FIG. 1 (PRIOR ART)
FIG. 1 is a cross-sectional view of a liquid pump of the prior art.

Referring first to FIG. 1, a valveless positive displacement piston pump 100 of the prior art is shown in cross-section. The pump 100 generally includes a pump housing 101 and a piston 118. The pump housing 101 preferably includes a plastic pump casing 102 having an inlet port 104 and an outlet port 106. The pump casing 102 defines a cylindrical chamber 108 having an open end 110. Received in the cylindrical chamber 108 is a ceramic piston liner 112 having a central longitudinal bore 114 and a transverse bore 116 communicating with the longitudinal bore. The transverse bore 116 includes a liner inlet port 116*a* fluidly communicating with the inlet port 104 of the pump casing 102 and a liner outlet port 116*b* fluidly communicating with the outlet port 106 of the pump casing so that a liquid can be pumped from the inlet port, through the liner, to the outlet port in a manner as will be described below.

The pump 100 further includes a ceramic piston 118 axially and rotatably slidable within the central bore 114 of the piston liner 112. One end of the piston 118 extends out of the open end 110 of the pump casing 102 and includes a coupling 120 for engagement with a motor. At its opposite end, the piston 118 is formed with a relieved or "cutout" portion 122 disposed adjacent the transverse bore 116 of the pump liner. As will be described below, the relieved portion 122 is designed to direct fluid into and out of the pump 100.

A seal assembly 124 is provided at the open end 110 of the pump casing 102 to seal the piston 118 and the pump chamber 108. The seal assembly 124 is retained at the open end 110 of the pump casing 102 by a gland nut 126 having a central opening 128 to receive the piston 118. The gland nut 126 is preferably attached to the pump casing 102 with a threaded connection 130 provided therebetween.

In operation, a motor (not shown) drives the piston 118 to axially translate and rotate within the central bore 114 of the piston liner 112. In order to draw liquid into the transverse bore 116 from the inlet port 104, the piston 118 is rotated as required to align the relieved portion 122 with the liner inlet port 116*a*. The piston 118 is then drawn back as required to take in the desired volume of liquid into the central bore 114 of the pump liner 112. Withdrawal of the piston 118 produces a negative pressure within the liner inlet port 116*a* of the transverse bore 116, which draws in liquid from the casing inlet port 104. The piston 118 is then rotated to align the relieved portion 122 with the liner outlet port 116*b*. Finally, the piston 118 is driven forward the required distance to force liquid into the outlet port 116*b* of the transverse bore 116 to produce the desired discharge flow.

The pump liner 112 shown if FIG. 1 also includes a transverse bore 132 that communicates with the central bore 114. This transverse bore 132 is sometimes used as part of a flushing system to clean the surfaces of the piston and liner. In such applications, the pump casing 102 would also include a flush port inlet and a flush port outlet (not shown in FIG. 1) disposed at opposite ends of the transverse flush bore 132 for circulating a flushing fluid through the liner.

Figure 2:
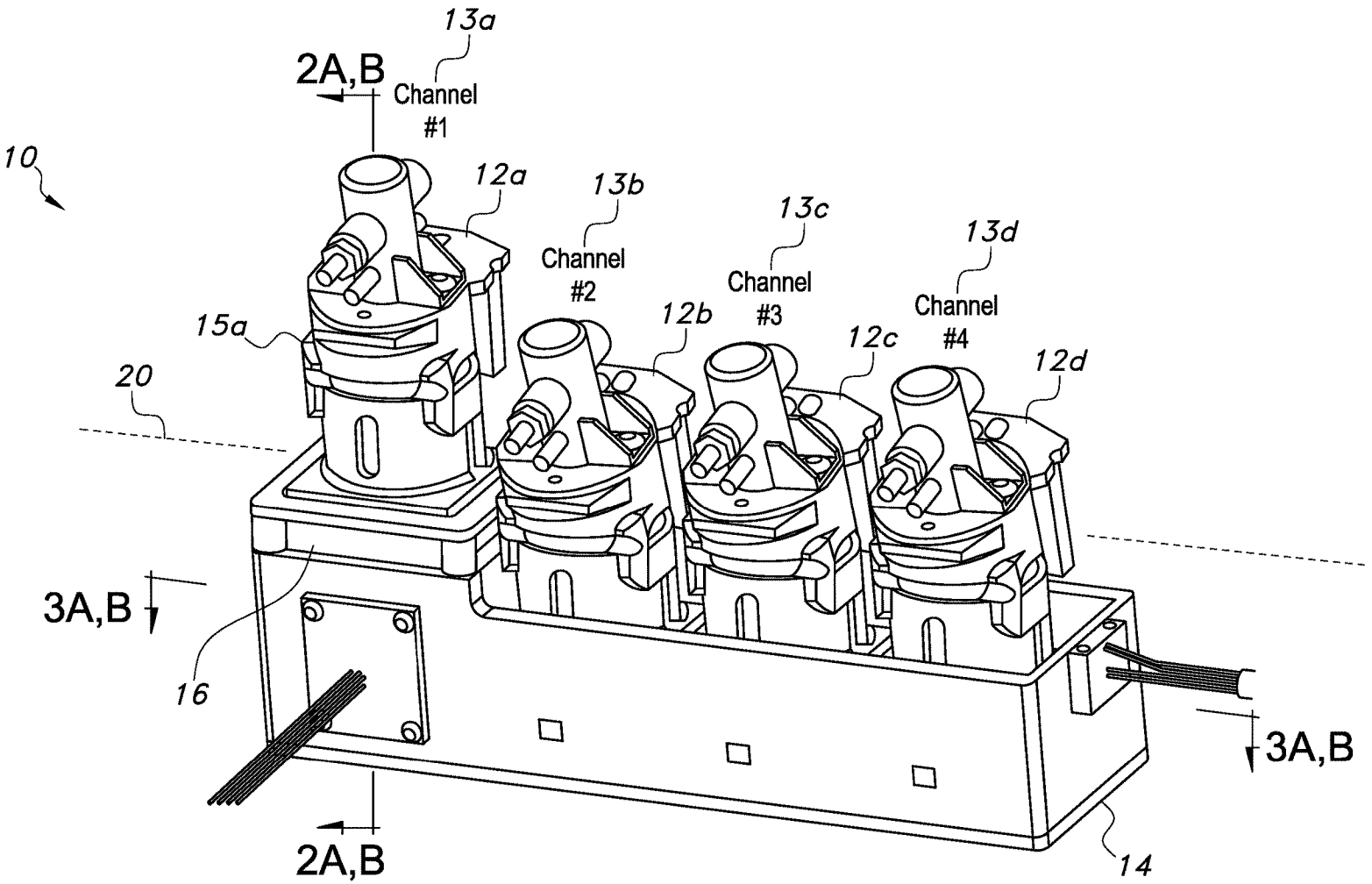
FIG. 2 is a top perspective view of the pump apparatus according to one aspect of the present invention.

Turning now to FIG. 2, a multi-channel pump apparatus 10 having four positive displacement piston pumps 12*a*, 12*b*, 12*c*, 12*d* is shown. The pumps 12*a*, 12*b*, 12*c*, 12*d* are similar to that as described above with respect to FIG. 1, but are modified according to the present invention as will be described in detail below.

Size limitations typically required for multi-channel pump applications have been met by a novel construction, as shown in FIG. 2, wherein a single housing 14 supports a single drive motor 16, which operates the four pumps 12*a*, 12*b*, 12*c*, 12*d*. The housing 14 gathers together the four pumps 12*a*, 12*b*, 12*c*, 12*d* in a much tighter formation than normally accommodated by pump components used in conventional pumps.

The single drive motor 16 is attached in a typical fashion to a first pump 12*a*. Specifically, the motor 16 includes a rotatable shaft 18 (shown in FIGS. 2*a*, 2*b*, 3*a* and 3*b*) having an upper portion 18' that engages the piston of the first pump 12*a* via a conventional pump/motor coupling 15*a* of the first pump, as described above with respect to FIG. 1. The first pump 12*a* can be termed a primary pump and is disposed in a "Channel #1 position" 13*a*, as shown in FIG. 2. The remaining pumps 12*b*, 12*c*, 12*d* can be termed secondary pumps and are disposed along a line 20 with the first pump 12*a*, in a stacking direction. These secondary pumps are respectively disposed in a "Channel #2 position" 13*b*, a "Channel #3 position" 13*c* and a "Channel #4 position" 13*d*, as also shown in FIG. 2.

Figure 2A:
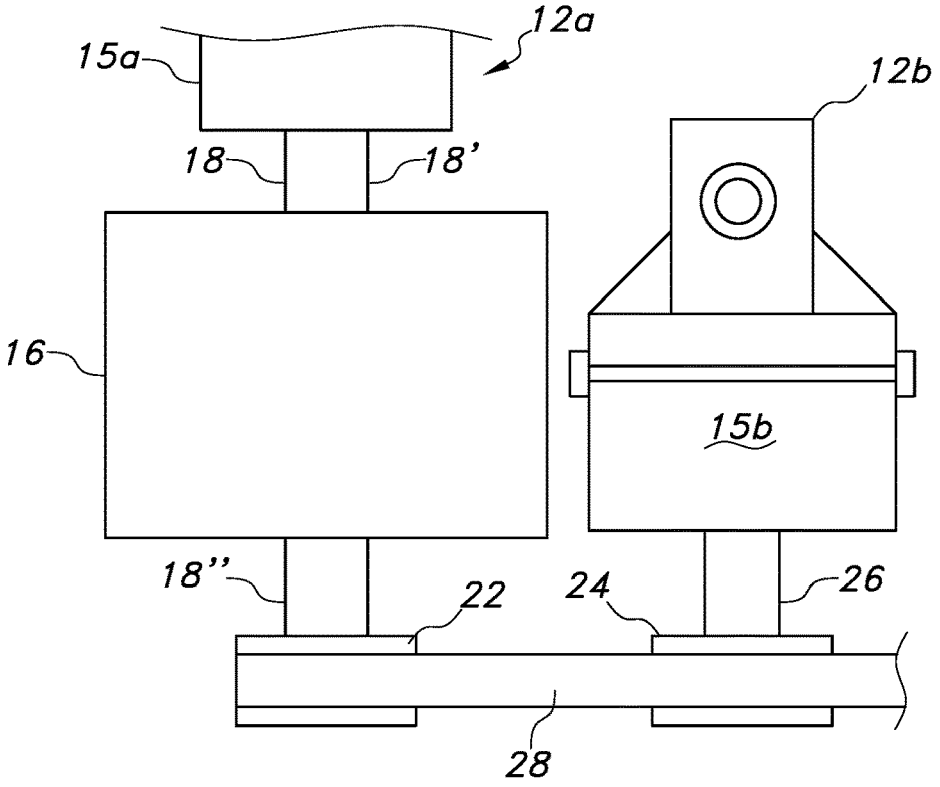
FIGS. 2*a* and 2*b* are schematic cross-sectional views of the pump apparatus shown in FIG. 2 taken along the line 2*ab*-2*ab*.
Figure 3A:
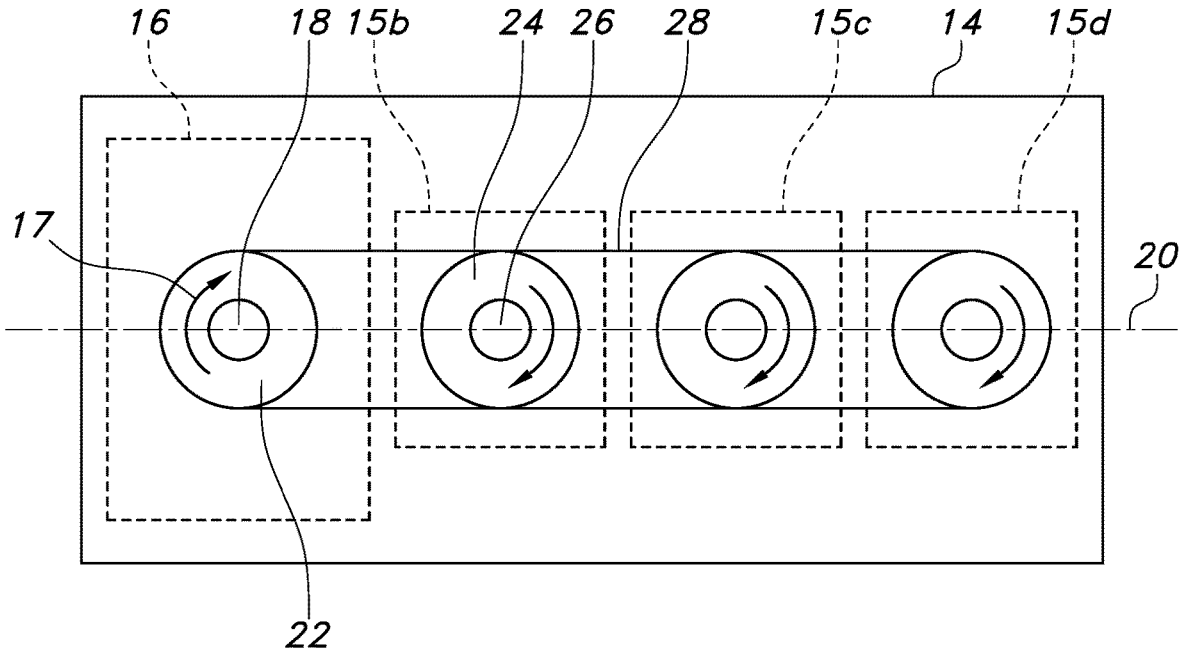
FIGS. 3*a* and 3*b* are schematic cross-sectional views of the pump apparatus shown in FIG. 2 taken along the line 3*ab*-3*ab*.

However, the drive shaft 18 of the motor 16 of the present invention further includes a lower portion 18" that extends from the back of the motor in a direction away from the primary first pump 12*a*. This lower extended shaft portion 18" can be equipped with a pulley 22, which engages a drive belt or chain 28, as shown in FIGS. 2*a* and 3*a*. The drive belt 28 drives a similar pulley 24 provided on a slave shaft 26 of a pump/motor coupling 15*b*, 15*c*, 15*d* for each of the respective secondary pumps 12*b*, 12*c*, 12*d*, as also shown in FIGS. 2*a* and 3*a*. In this manner, rotation of the motor shaft 18 drives rotation of the piston of the first pump 12*a* in a first direction as indicated, for example, by the clockwise arrow 17 in FIG. 3*a*, and further drives rotation of the pistons of the secondary pumps in the subsequent channels #2, #3, #4 in the same clockwise direction. The pulleys of each pump can be engaged by virtue of a toothed or smooth drive belt 28, or by multiple drive belts.

Figure 2B:
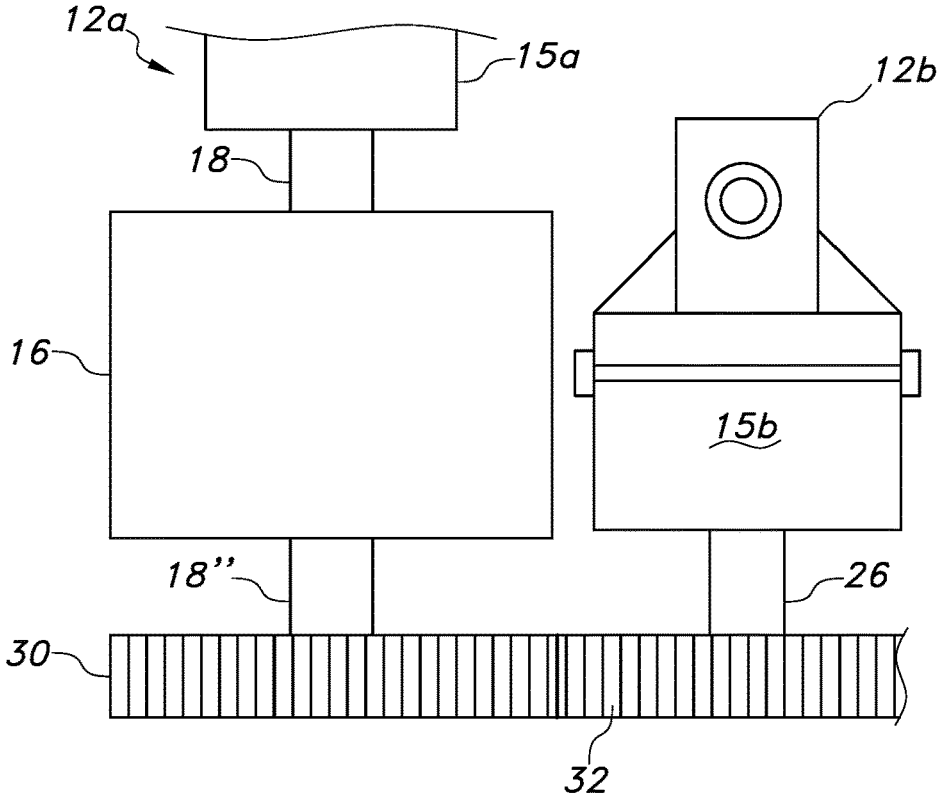
Figure 3B:
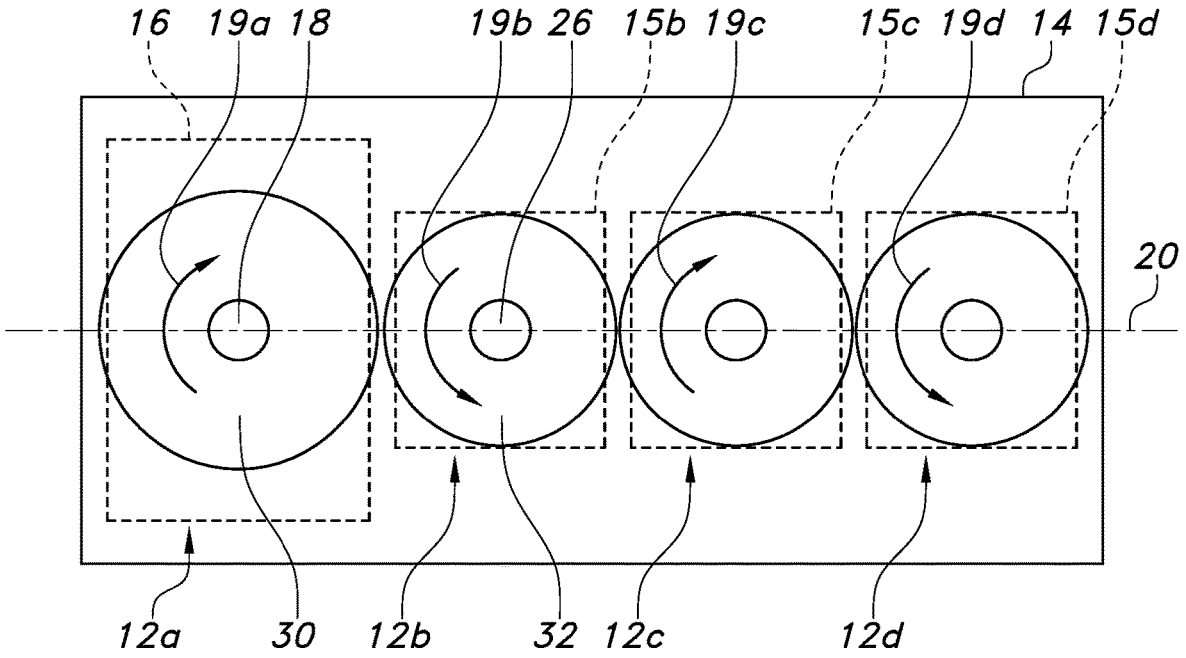

In an alternative embodiment, as shown in FIGS. 2*b* and 3*b*, the lower portion 18" of the motor drive shaft 18 is fixed to a toothed gear 30, which in turn engages a toothed gear 32 provided on the slave shaft 26 of the immediately adjacent secondary pump 12*b*. Similarly, the toothed gear 32 of the secondary pump 12*b* disposed in the "Channel #2 position" 13*b* engages a toothed gear 32 provided on the slave shaft 26 of the immediately adjacent secondary pump 12*c* in the "Channel #3 position" 13*c*, and so on. In this manner, rotation of the motor shaft 18 drives rotation of the piston of the first pump 12*a* in a first direction as indicated, for example, by the clockwise arrow 19*a* in FIG. 3*b*, and further drives rotation of the pistons of the secondary pumps in the subsequent channels #2, #3, #4 in sequentially alternating directions, as indicated by the counter-clockwise arrow 19*b*, the clockwise arrow 19*c* and the counter-clockwise arrow 19*d*. It is also conceivable that the multi-channel pump apparatus 10 can be built with all gears, all pulleys with belts or a combination of pulleys, gears and belts.

Returning to FIG. 1, pump heads employed in conventional rotating/reciprocating designs present inlet and outlet ports 104, 106 on opposite sides of the pump head. This is a direct result of the coordinated piston rotation which is timed in concert with piston axial position in the pump head. The rotation timing is such that the valving flat portion 122 of the piston 114 first faces an inlet port 104 while the piston moves axially out of its mating cylindrical cavity. This action draws fluid into the cylindrical cavity. When the piston 114 has rotated 180° the flat 122 is now aligned with the outlet port 106 on the opposite side of the pump head and axial motion of the piston into the mating cylindrical cavity discharges the fluid from the pump head.

However, as mentioned above, it is desirable with multi-channel pump systems to have all inlets and outlets of all channels on one side of the pump. The present invention provides a novel means for having both an inlet and outlet port on the same side of the pump head.

Figure 4:
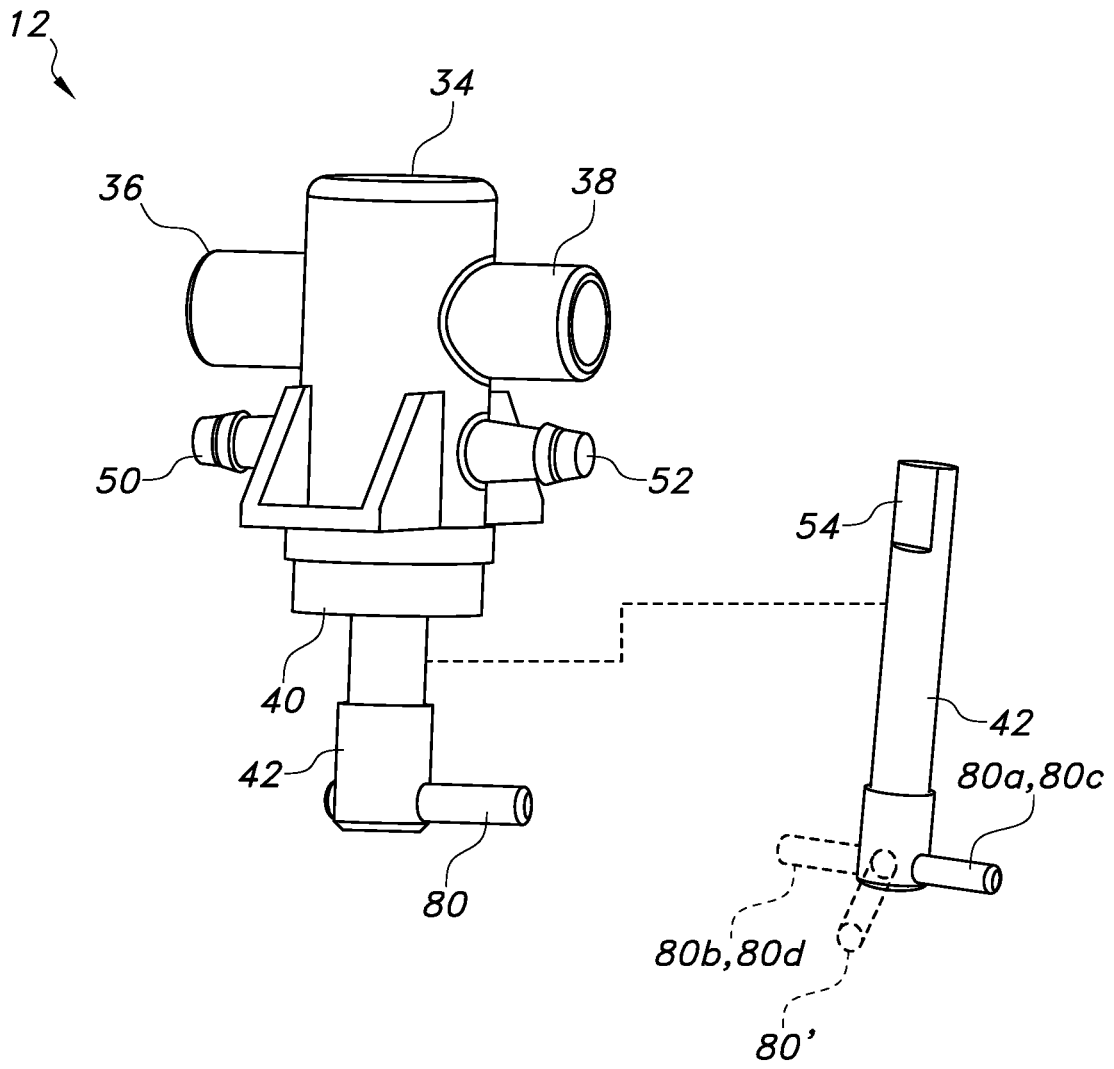
FIG. 4 is an isolated perspective view of one of the pumps shown in FIG. 2.
Figure 5:
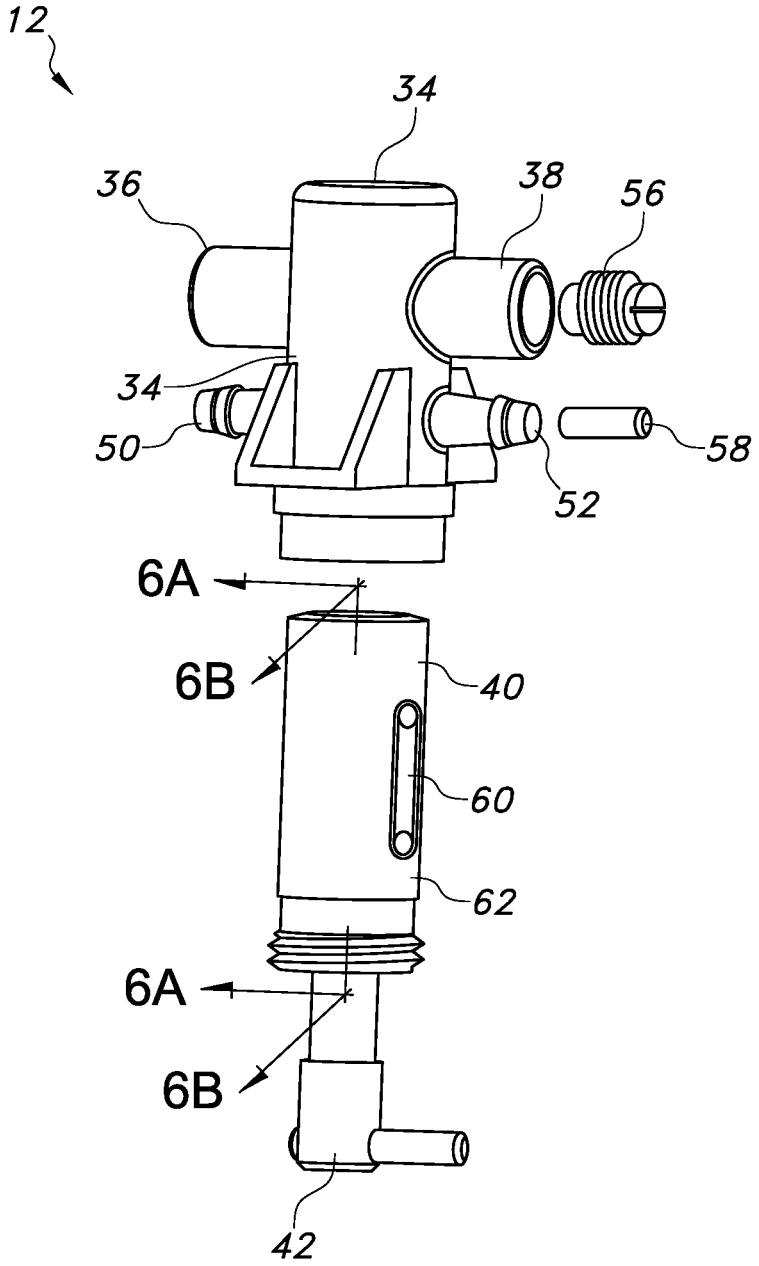
FIG. 5 is a partially exploded view of the pump shown in FIG. 4.
Figure 6A:
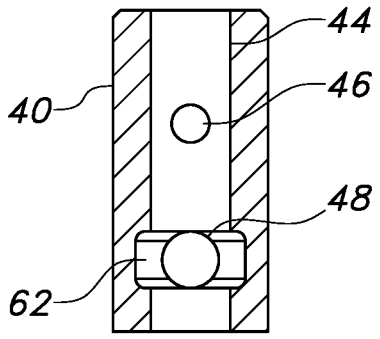
FIG. 6*a* is a cross-sectional view of the liner of the pump shown in FIG. 5, taken along the line 6*a*-6*a*.
Figure 6B:
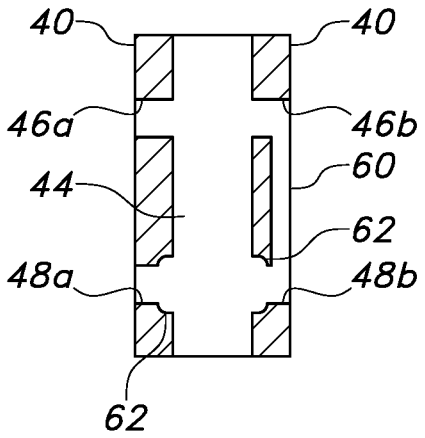
FIG. 6*b* is a cross-sectional view of the liner of the pump shown in FIG. 5, taken along the line 6*b*-6*b*.

Referring now to FIGS. 4 and 5, the pump 12 according to an aspect of the present invention includes a pump casing 34 having an inlet port 36 and an outlet port 38. The pump casing 34 defines a cylindrical chamber having an open end for receiving a ceramic piston liner 40. As discussed above, the piston liner 40 has a central longitudinal bore 44 for receiving the reciprocating and rotating piston 42. Referring additionally to FIGS. 6*a* and 6*b*, the liner 40 is formed with a central longitudinal bore 44, a first transverse bore 46 communicating with the longitudinal bore and a second transverse bore 48 also communicating with the central longitudinal bore. The first transverse bore 46 includes a liner inlet portion 46*a* fluidly communicating with the inlet port 34 of the pump casing 34 and a liner outlet portion 46*b*, which would normally communicate with the outlet port 38 of the pump casing so that a liquid can be pumped from the inlet port, through the liner, to the outlet port in a manner as described above.

Similarly, the second transverse bore 48 includes an inlet portion 48*a* fluidly communicating with a flush system inlet port 50 of the pump casing 34 and an outlet portion 48*b*, which would normally communicate with the flush system outlet port 52 of the pump casing so that a flush liquid can be pumped from the inlet port, through the liner, to the outlet port in a manner as described above.

The piston 42 of the pump 12 shown in FIGS. 4 and 5 is similar to the piston 118 of the conventional pump 100 described above. Specifically, the piston 42 axially and rotatably slides within the central bore 44 of the piston liner 40, wherein one end of the piston extends out of the open end of the pump casing 34 and includes a drive pin 80 for engagement with a pump/motor coupling (not shown), which, in turn is coupled to a motor (not shown). At its opposite end, the piston 42 is formed with a relieved or "cutout" portion 54 disposed adjacent the transverse bore 46 of the pump liner 40 for directing fluid into and out of the pump 12.

However, unlike the pump described above, the pump casing 34 and the liner 40 of the pump formed in accordance with one aspect of the present invention is adapted to provide an inlet and outlet port on the same side of the pump head. This is achieved by blocking both the outlet 38 of the primary pumping path and the outlet 52 of the secondary flushing path on one side of the pump. As will be discussed in further detail below, the liner 40 is also adapted to provide a fluid path within the pump head to allow transfer of the fluid from the primary inlet port 36 to the flush outlet port 52 on the same side of the pump.

Plugging of the outlet port 38 is achieved by inserting an externally threaded plug 56 into the internally threaded outlet port 38. The plug 56 is designed to provide a fluid-tight seal at the outlet port 38. Similarly, a flush outlet plug 58 is inserted into the flush outlet 52 of the casing 34 to seal the flush outlet in a fluid-tight manner. Given that a typical flush outlet is formed with a barb fitting to attach a flush fluid hose, the flush outlet plug can be designed to be press-fit into the inner diameter of the flush outlet. In this manner, fluid is prevented from leaving both the primary outlet port 38 and the flush outlet port 52 of the pump casing.

An alternative fluid path is provided in the liner 40 by forming a groove 60 in the outside surface 62 of the ceramic liner 40, as shown in FIG. 6*b*. This groove 60 communicates with both the outlet portion 46*b* of the first transverse bore 46 and the outlet portion 48*b* of the second transverse bore 48 to provide a fluid path therebetween on one side of the liner.

The liner 40 further includes an internal annular groove 62 formed in the inner surface of the longitudinal bore 44 adjacent the second transverse bore 48. The annular groove 62 communicates with both the inlet portion 48*a* and the outlet portion 48*b* of the second transverse bore 48 to provide a fluid path around the piston 42, as will be discussed below.

Figure 7B:
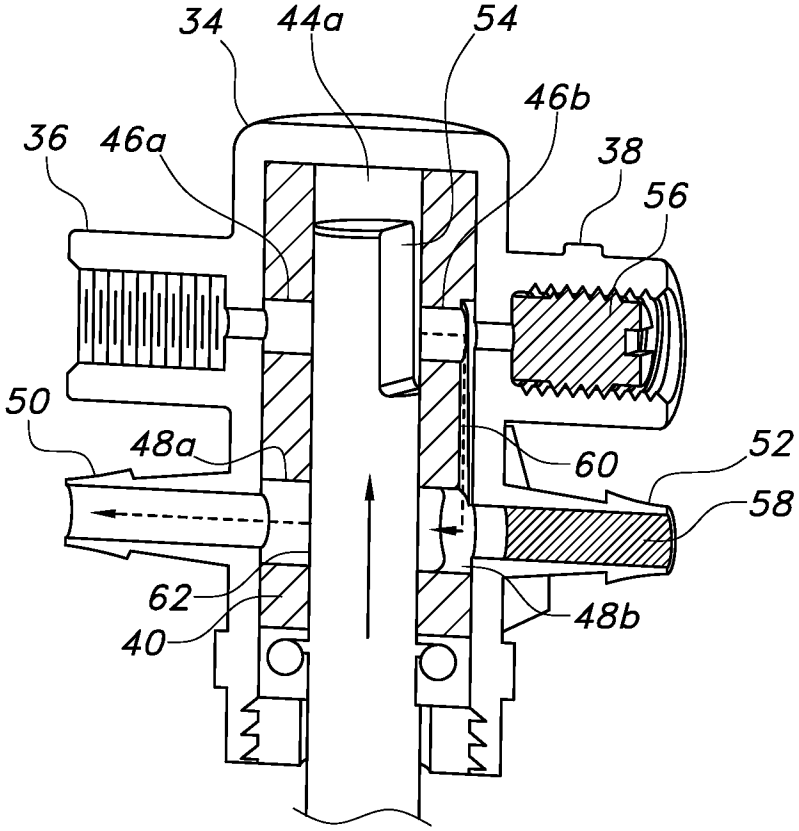
FIGS. 7*a* and 7*b* are sequential cross-sectional views of the pump shown in FIG. 4.
Figure 7A:
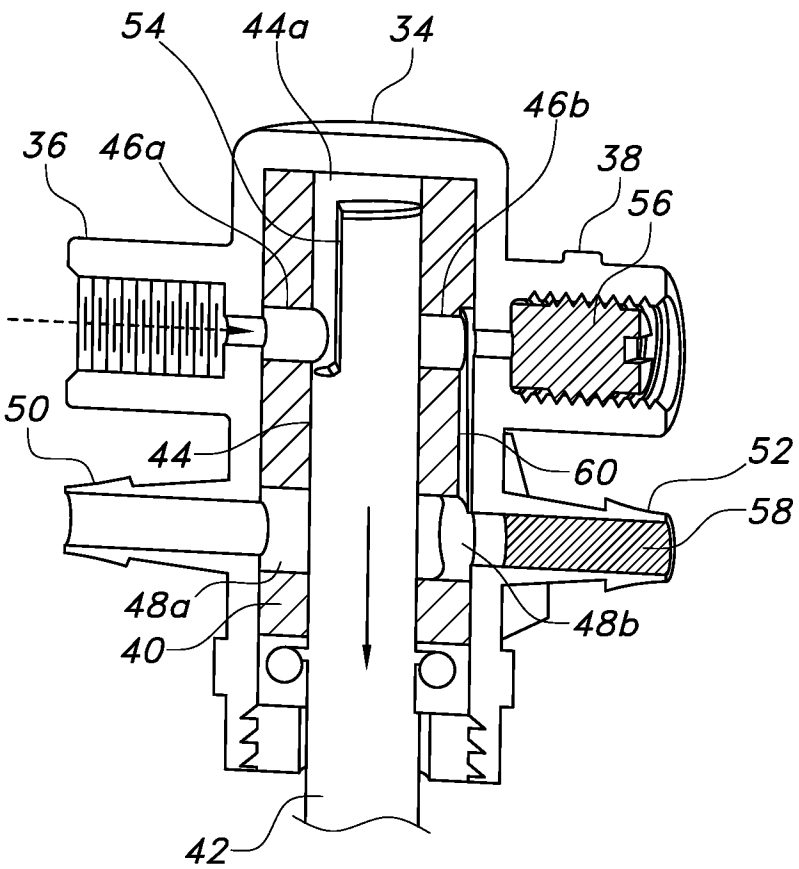

Referring now to FIGS. 7*a* and 7*b*, when the flat 54 of the piston 42 flat is aligned with an intake port 36 on one side of the pump head, the piston moves axially outwards, drawing fluid into a forward area 44*a* of the pump head longitudinal bore, through that port. When rotation of the piston 42 brings the flat 54 in alignment with the port 38 on the opposite side of the intake port 36, the piston moves axially inwards, pushing fluid out of the longitudinal forward area 44*a* into the outlet portion 46*b* of the first transverse bore 46. However, because the casing outlet 38 is blocked by the plug 56, fluid exiting the outlet portion 46*b* is forced into the groove 60 formed on the outer surface of the liner 40 instead of continuing out through the casing 34.

The fluid flows axially along the path defined by the groove 60 and the inner surface of the pump casing 34 and reenters the liner 40 through the outlet portion 48*b* of the second transverse bore 48. The casing flush port 52 is blocked by the plug 58 so that fluid flow has no choice but to continue through the flush circuit of the second transverse bore 48 formed into the liner 40. After entering the outlet portion 48*b* of the second transverse bore, the fluid now flows perpendicular to the axial direction through the liner 40 and around the piston 42 via the internal annular groove 62 formed on the inner surface of the central longitudinal bore 44. Once exiting the generous gap provided by the trepanned internal circular path of the annular groove 62, the fluid exits the liner 40 via the inlet portion 48*a* of the second transverse bore 48 into the flush inlet port 50 of the pump casing 34.

Figure 8:
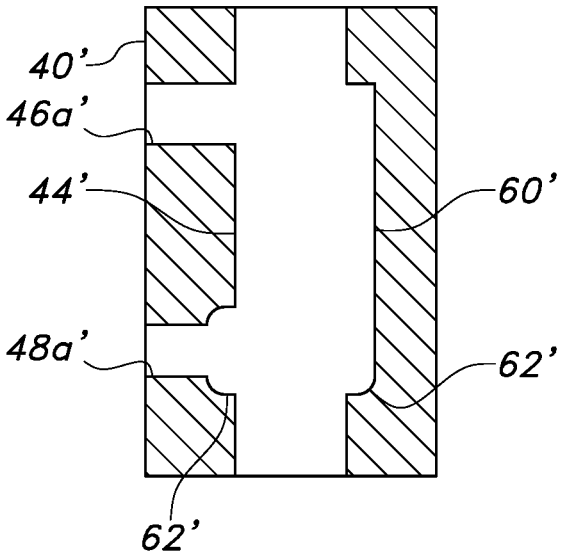
FIG. 8 is a cross-sectional view of an alternative embodiment of the liner of the pump shown in FIG. 5, taken along the line 6*b*-6*b*.

FIG. 8 shows a liner 40' according to an alternative embodiment of the present invention. In this embodiment, the longitudinal fluid path groove 60' is formed internally in the inner surface of the longitudinal bore 44' opposite the transverse inlet portion 46*a'* and the transverse outlet portion 48*a'*. An internal annular groove 62' is also formed on the inner surface of the longitudinal bore 44' adjacent the inlet portion 48*a'* of the second transverse bore, as described above. This annular groove 62' communicates with both the inlet portion 48*a'* and the outlet portion 48*b'* of the second transverse bore to provide a fluid path around the piston 42, as described above.

The longitudinal groove 60' and the annular groove 62' in this embodiment would create a "loop-back" channel for fluid flow very similar to what is shown in FIGS. 7*a* and 7*b*, but the channel would be disposed between the outer diameter of the piston 42 and the inner diameter of the liner 40'.

Figure 9B:
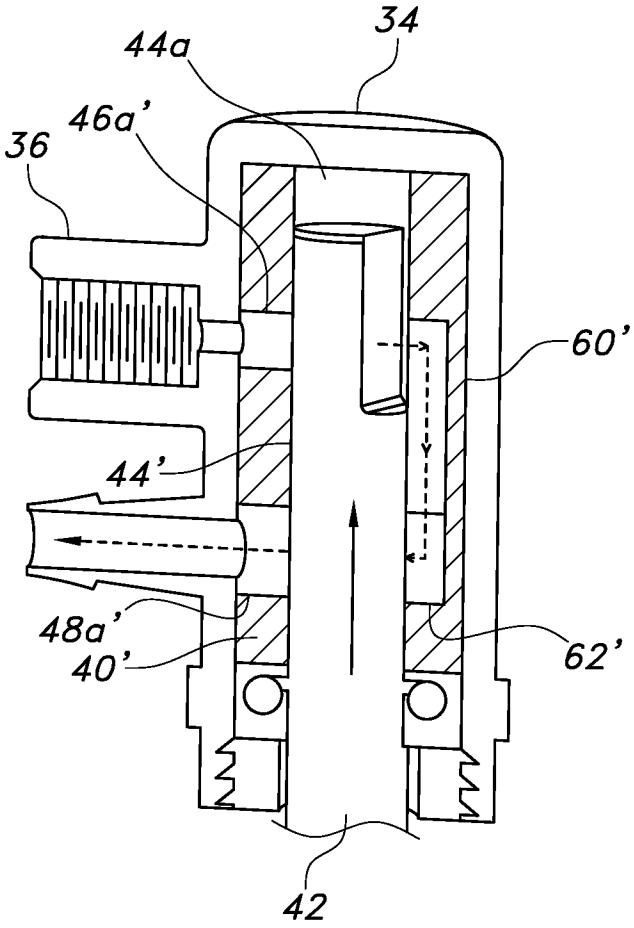
FIGS. 9*a* and 9*b* are sequential cross-sectional views of the pump utilizing the alternative liner shown in FIG. 8.
Figure 9A:
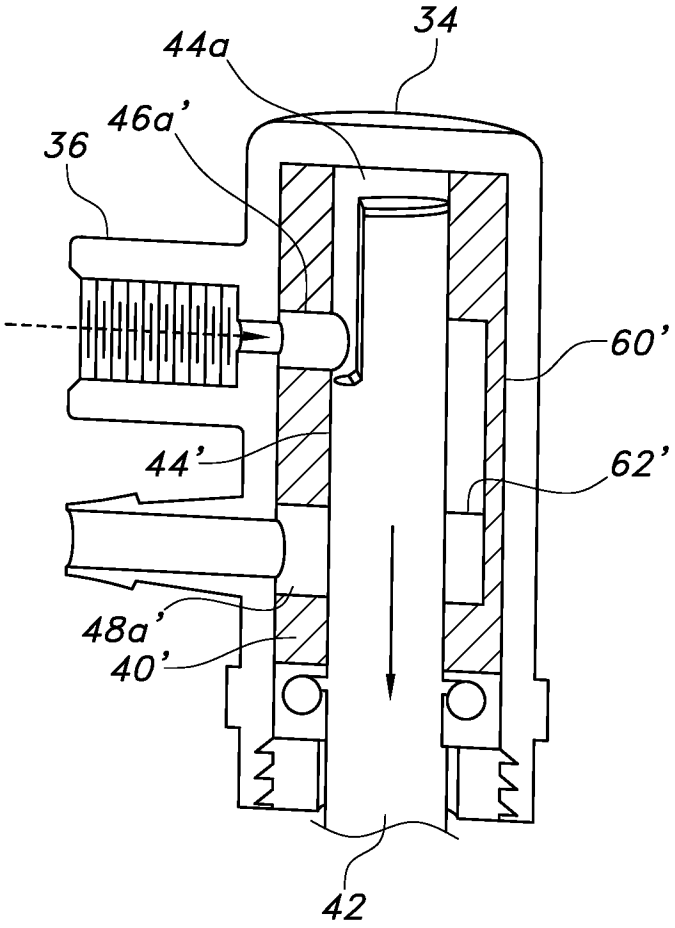

Specifically, as shown in FIGS. 9*a* and 9*b*, when the flat 54 of the piston 42 flat is aligned with an intake port 36 on one side of the pump head, the piston moves axially outwards, drawing fluid into the pump head through that port. When rotation of the piston 42 brings the flat 54 to the side of the liner 40' opposite the intake port 36, the piston moves axially inwards, pushing fluid into the longitudinal groove 60' formed in the inner surface of the longitudinal bore 44' instead of continuing out through the casing 34. The fluid flows along the path defined by the groove 60' in the inner surface of the liner 40' and continues to the annular groove 62' formed on the inner surface of the central longitudinal bore 44' where it exits the liner 40' via the inlet portion 48*a'* into the flush inlet port 50 of the pump casing 34.

One advantage of the design shown in FIGS. 8, 9*a* and 9*b* is the cleansing action created by piston movement across the sharp edges of the channel. The sharp edges serve as a sort of "doctoring blade" to scrape away crystals forming within the pump which might otherwise lead to jamming of the parts. As can also be appreciated, in this embodiment, the outlet portion 46*b* of the first transverse bore 46, the outlet portion 48*b* of the second transverse bore 48, the outlet port 38 of the casing 34, the casing flush port 52 and both plugs 56 and 58 can all be eliminated.

As a result of both alternative embodiments, the fluid to be pumped enters and exits the pump on the same side. In this fashion, the pump head has been modified from its conventional port arrangement to yield the desired single sided port location.

Figures 10A, 10B:
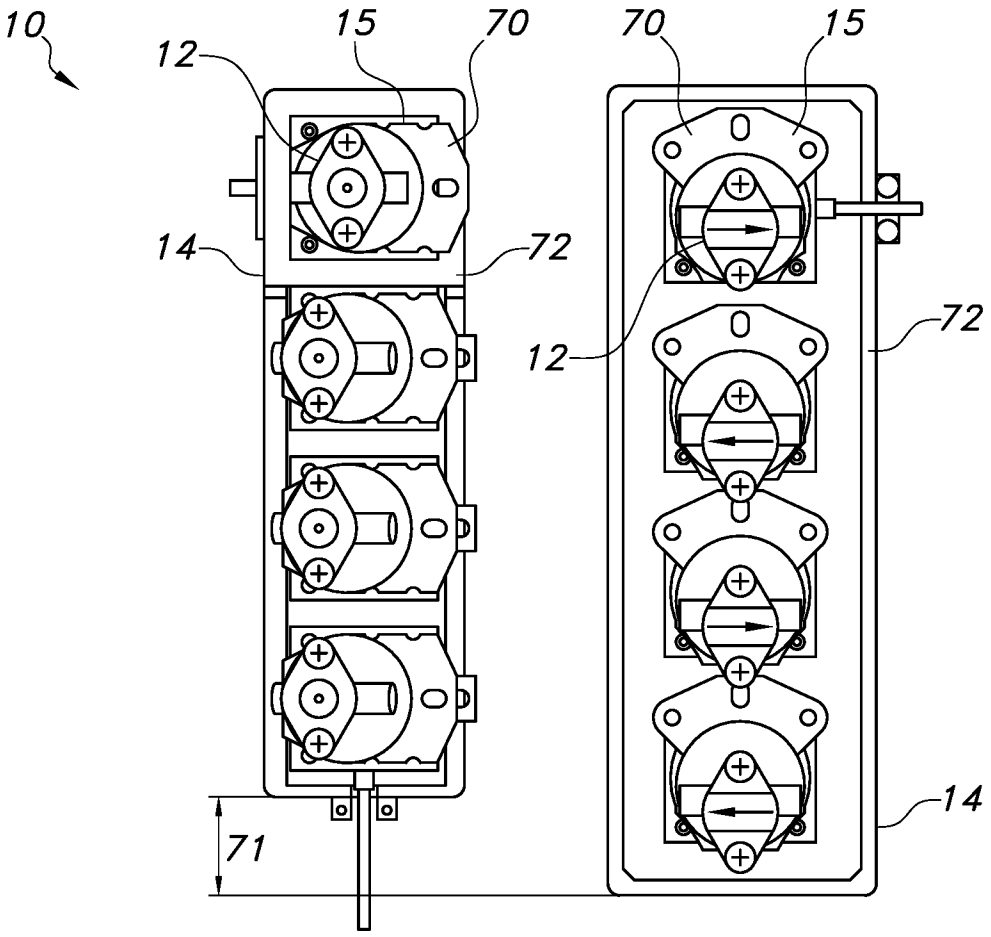
FIGS. 10*a* and 10*b* are top views illustrating a reduction in overall size of the pump apparatus according to the present invention.

In another aspect of the present invention, the overall size of the multi-channel pump apparatus 10 can be further reduced by rotating each pump body, (including the pump head 12 and pump/motor coupling 15), 90° from its normal mounting arrangement. This arrangement is shown in FIG. 10*a*, as compared to an unmodified arrangement shown in FIG. 10*b*. The arrangement shown in FIG. 10*a* allows for reduction in spacing 71 from pump-to-pump of the multi-channel design because a large projection 70 extending out of the base of each pump/motor coupling 15 is oriented away from the neighboring pump base towards the outer longitudinal edge 72 of the pump apparatus housing structure 14.

This 90° base rotation would normally result in neighboring pump head ports facing each other, which is an undesirable configuration making tubing connections difficult. In order to accommodate this base rotation and still allow for proper operation of the individual pump heads, another design change is presented whereby the driving pin 80 attached to the end of the piston 42 is rotated 90° from its typical orientation of having its axis perpendicular to the piston flat surface 54, (as shown as 80' in dashed lines in FIG. 4), to a new position having its axis parallel to the flat surface 54, (as shown as 80*a,c* in solid lines in FIG. 4).

Figure 11B:
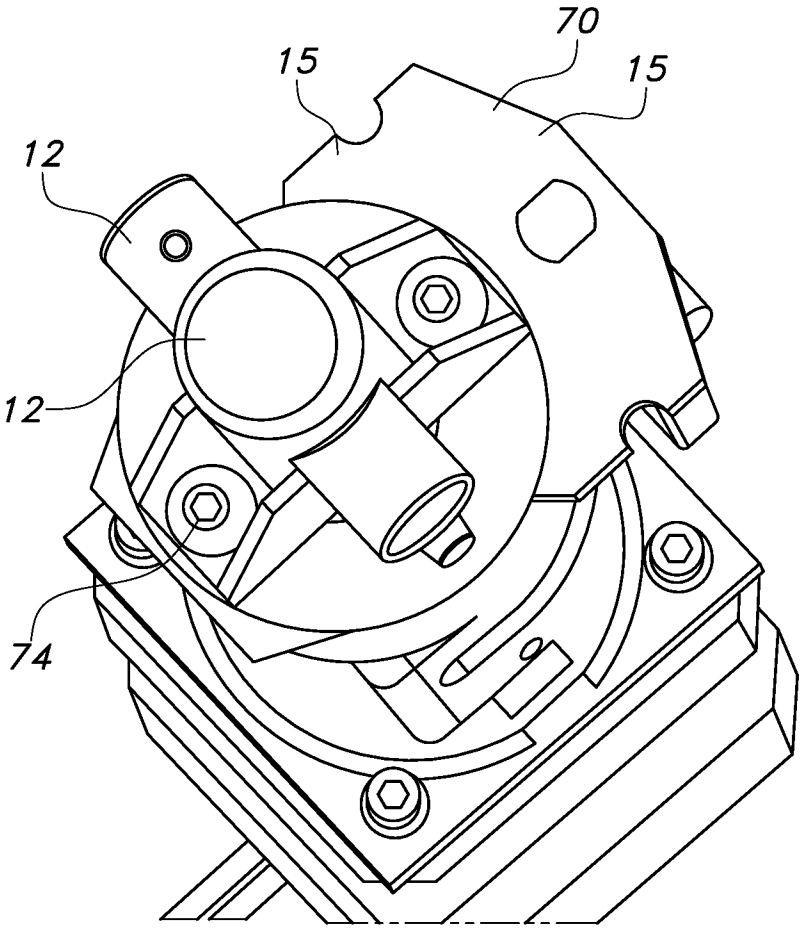
FIGS. 11*a* and 11*b* show the pump head being rotated by 90 degrees with respect to the pump base to achieve the reduction in size shown in FIG. 8*a*.
Figure 11A:
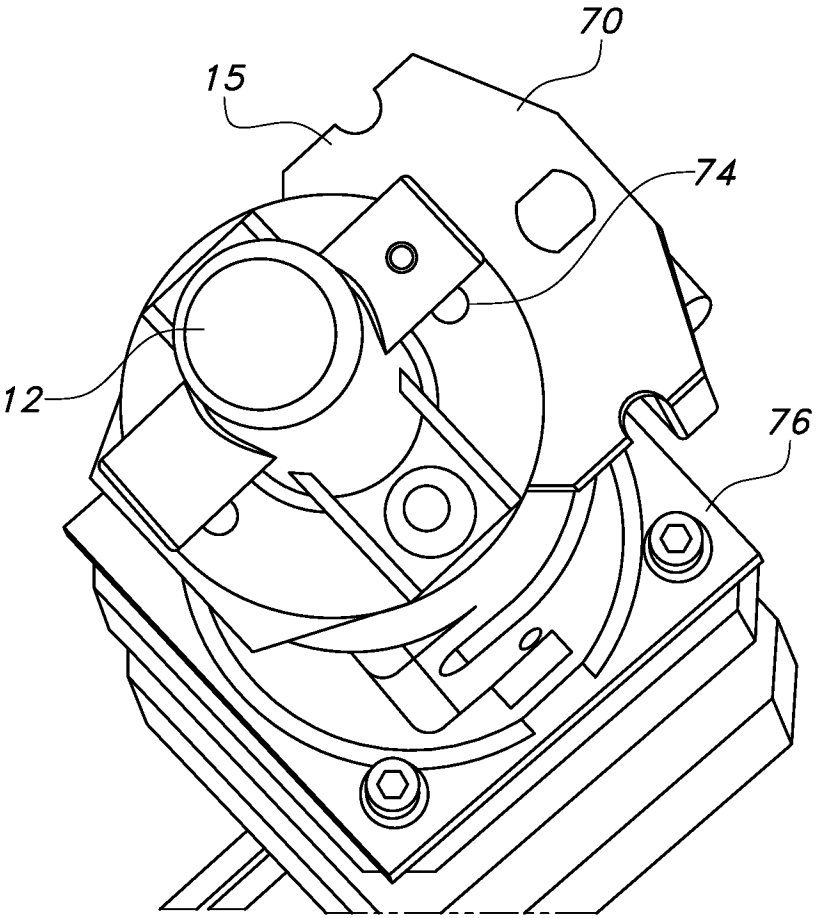

This also required 900 rotation of the pump head 12 from its normal alignment on the pump base 15 and introduction of suitable new mounting means to secure the rotated pump head 12 to the pump base 15, as shown in FIGS. 11*a* and 11*b*. Specifically, upon rotation of the pump head 12, the standard threaded holes 74 provided on the pump/motor coupling 15 are no longer used. New threaded holes 76, oriented 90° in the radial direction with respect to the original threaded holes 74, are thus created to accept the repositioned screws of the rotated pump head 12.

As described above with respect to the gears, belts and pulleys used to drive pump channels #2, #3, and #4 from the motorized channel #1 pump 12*a*, another difficulty arises from the geared situation. This causes neighboring channels to be driven in opposite rotation, as shown in FIG. 3*b*. The requirement of having all ports functioning in unison cannot be achieved unless an additional design change is made. The problem presented here has been solved by having the drive pins 80 of the pistons 42 oriented parallel to their piston flats 54, as shown in FIG. 4, but offset by 180° from each other in an alternating manner from one pump to the next.

For example, if the pump apparatus of FIG. 2 is gear driven, as shown in FIG. 3*b*, the first pump 12*a* and the third pump 12*c*, (respectively occupying the channel #1 and the channel #3 positions) would have pistons with drive pins oriented parallel to the piston flats 54, as shown by the solid lines depicting the drive pins 80*a*, 80*c* shown in FIG. 4. On the other hand, the second pump 12*b* and the fourth pump 12*d*, (respectively occupying the channel #2 and the channel #4 positions) would have pistons with drive pins 80*b*, 80*d* oriented parallel to the piston flats 54, but offset by 180° as compared to the drive pins of the first and third pumps 12*a*, 12*c*. This is illustrated by the dashed lines depicting the drive pins 80*b*, 80*d* shown in FIG. 4. By these means, neighboring pumps can be synchronized regardless of individual rotation directions.

Among the particular properties of multi-channel peristaltic pumps currently used in analytical machines of the prior art is that they require high torque drives and run at relatively low speed. This has been addressed in conventional equipment by using comparatively high torque 23-frame stepper motors driving these pumps through a 5:1 gear reduction. Driving circuitry for this motor delivers stepper pulsations causing the motor to turn at about 308 RPM. The gearbox output to the peristaltic pump channels is ⅕ of this speed or close to 62 RPM.

The multi-channel rotating/reciprocating pump design of the present invention incorporates a smaller 17-frame stepper motor and no speed reduction gearbox. In order for this pump to achieve backward compatibility with legacy machines, it is necessary to directly connect the smaller motor to the existing driver electronics. The issue of torque is not a problem because the required rotational force to operate the reciprocating/rotating pump is far lower than that required for a peristaltic pump.

It is preferable to run the pump at lower than 308 RPM, particularly for channels 2, 3 and 4, whose role is to withdraw waste fluids from test vessels through small bore tubing of typically 0.062 inch. Small bore tubing can create problems for fluidic circuits when high pulse rates are used because the fluid column leading to the pump within the tubing must be accelerated at high rates on the pump inlet side. This acceleration of the fluid column within the tubing is limited by atmospheric pressure available to push the fluid towards the partial vacuum being created by the action of the pump. If the fluid fails to accelerate sufficiently then cavitation occurs and fluid flow through the pump drops.

There is a required flow rate in the analytical machines for aspiration of the waste liquid. Knowledge of pump speed and flow angle for pump displacement per revolution allows selection of a flow angle to achieve the desired flow rate for a given pump speed. Testing of early prototypes revealed that a pump whose displacement was so determined would not reliably aspirate at the required flow rate when run at 308 RPM when connected to the small bore tubing. The flow rate was being impeded by cavitation at the inlet to the pump. This problem was readily overcome by lowering the speed of the pump while adjusting the pumps displacement accordingly.

Early prototypes employed a 4:1 speed reduction belt and pulley arrangement between channel #1 and channel #2 which gave channels 2, 3 and 4 a speed of approximately 77 RPM. At this lower speed coupled with a higher flow angle for desired fluid displacement/revolution the pumps performed well and no cavitation was observed. The pump 12*a* in the #1 channel location is required to aspirate at approximately double that of the other channels and legacy equipment provides larger bore (0.125") tubing for this channel. No cavitation issues were encountered with this arrangement. At first, this concept of channel #1 running at 308 RPM and connected to larger bore tubing while the other channels ran at 77 RPM with small bore tubing appeared to satisfy fluidic requirements but certain timing issues within the analytical testing machine revealed that the 77 RPM pump rate might be unsatisfactory.

Accordingly, it was decided that the speed of the channels 2-through-4 pumps needed to be raised to approximately 154 RPM. Although this can be achieved through suitable selection of pulley diameters to arrive at the needed 2:1 speed reduction a more direct method was chosen which employed a stepper motor of special windings and internal construction. Whereas the original 17 frame stepper motor used in early prototypes produces 1.8° of revolution for each pulse, a special version of this motor was obtained which rotates only 0.9° for each pulse. Use of this motor results in channel #1 rotating at half speed or 154 RPM. This then allows direct gearing from each channel with no need for speed reduction. At this speed it was found that the channels 2-through-4 are able to operate with small bore tubing and deliver required flow rate without cavitation.

Another compatibility issue faced by the multi-channel reciprocating/revolving pump design is associated with a flag and sensing function incorporated in the peristaltic multi-channel pumps. That apparatus is connected to the 23-frame stepper motor shaft, wherein a flag with aperture rotates with the motor shaft. An optical sensing device positioned to look through the aperture is connected electrically to the machine electronics in such a way that an interruption in motor rotation is seen as a loss in sensor pulses and an alarm function provides an alert that the waste pump has stopped functioning. In order for the multi-channel rotating/reciprocating pump to satisfy the compatibility requirement it needs to be able to provide the same alert directly to the legacy machine electronics should there be any interruption in pump operation.

Initially it was thought sensors and flags would need to be placed at each of the four channels. These four sensors would then need to be provided with additional electronics to be able to connect, as a group, into the existing machine electronics. A far simpler and more direct solution to this issue was developed by placing just one sensor and flag unit on the slave shaft of channel #4 pump. By this expedient, any malfunction of any of the channels is sensed by loss of pulses from channel #4 and no special circuitry is required in order to provide compatibility with the legacy electronics.

As a result of the present invention, a novel means for utilizing a valveless positive displacement piston pump is provided, wherein multiple pumps are configured in a multiple channel format as a substitute for multi-channel peristaltic and diaphragm pumps.

The valveless pump has known advantages ideally suited to address the problems described above. There are no elastomeric elements to fail from fatigue stress. There are no check valves to malfunction. The extreme durability of the ceramic pumping components mean fluid flow accuracy and pump integrity are not compromised for a length of time far exceeding that of other pump designs.

Although preferred embodiments of the present invention have been described herein with reference to the accompanying drawings, it is to be understood that the invention is not limited to those precise embodiments and that various other changes and modifications may be affected herein by one skilled in the art without departing from the scope or spirit of the invention, and that it is intended to claim all such changes and modifications that fall within the scope of the invention.

What is claimed is:

1. A multi-channel positive displacement piston pump apparatus comprising:

a motor; and a plurality of positive displacement piston pumps driven by said motor, said plurality of pumps being aligned in a stacking direction, wherein each of said plurality of pumps comprises:

a pump housing defining a central longitudinal bore; and a pump piston axially and rotatably slidable within said central longitudinal bore for pumping a liquid through said pump housing, wherein said pump housing further comprises:

an inlet port;

an outlet port, said outlet port facing in a same direction as the inlet port generally perpendicular to said stacking direction;

a first transverse bore communicating with said central longitudinal bore for conveying the liquid from said inlet port to said central longitudinal bore;

a second transverse bore communicating with said central longitudinal bore for conveying the liquid from said central longitudinal bore to said outlet port;

a longitudinal groove extending between said first transverse bore and said second transverse bore for conveying the liquid therebetween; and an annular groove formed in said central longitudinal bore at a juncture of said central longitudinal bore and said second transverse bore for conveying the liquid from the longitudinal groove around the piston to the second transverse bore, and wherein said pump housing further comprises:

a pump casing having said inlet port and said outlet port; and a liner received within said pump casing, said liner having said central longitudinal bore, said first transverse bore, said second transverse bore, said longitudinal groove and said annular groove, and wherein said pump casing further comprises:

a first plugged port disposed opposite said inlet port; and a second plugged port disposed opposite said outlet port.

2. The multi-channel positive displacement piston pump apparatus as defined in claim 1, wherein each pump piston comprises a distal end received within the central longitudinal bore of the pump housing and a proximal end opposite the distal end extending out from the pump housing, said distal end having a relieved portion defining a flat surface and said proximal end having a drive pin extending radially outwardly from a circumferential surface of the piston, and wherein said plurality of positive displacement pumps includes a first pump and a second pump immediately adjacent to the first pump, the drive pin of the piston of the first pump extending parallel with the flat surface of the piston of the first pump, and the drive pin of the piston of the second pump extending perpendicular to the flat surface of the piston of the second pump.

3. The multi-channel positive displacement piston pump apparatus as defined in claim 1, wherein each pump piston comprises a distal end received within the central longitudinal bore of the pump housing and a proximal end opposite the distal end extending out from the pump housing, said distal end having a relieved portion defining a flat surface and said proximal end having a drive pin extending radially outwardly from a circumferential surface of the piston, and wherein said plurality of positive displacement pumps includes a first pump and a second pump immediately adjacent to the first pump, the drive pin of the piston of the first pump extending in a direction parallel with the flat surface of the piston of the first pump, and the drive pin of the piston of the second pump extending parallel with the flat surface of the piston of the second pump, but extending in a direction opposite the direction of the drive pin on the piston of the first pump.

4. The multi-channel positive displacement piston pump apparatus as defined in claim 1, wherein said motor includes a rotatable shaft, the rotatable shaft having an upper portion and a lower portion, the upper portion being engaged with a first pump of said plurality of pumps, and the lower portion extending in a direction opposite the upper portion away from the first pump of said plurality of pumps and engaged with at least a second pump of said plurality of pumps via at least one of a gear arrangement or a pulley arrangement.

5. The multi-channel positive displacement piston pump apparatus as defined in claim 1, wherein said longitudinal groove is formed in an inner surface of said liner defining said central longitudinal bore.

6. A multi-channel positive displacement piston pump apparatus comprising:

a motor; and a plurality of positive displacement piston pumps driven by said motor, said plurality of pumps being aligned in a stacking direction, wherein each of said plurality of pumps comprises:

a pump housing defining a central longitudinal bore; and a pump piston axially and rotatably slidable within said central longitudinal bore for pumping a liquid through said pump housing, wherein said pump housing further comprises:

an inlet port;

an outlet port, said outlet port facing in a same direction as the inlet port generally perpendicular to said stacking direction;

a first transverse bore communicating with said central longitudinal bore for conveying the liquid from said inlet port to said central longitudinal bore;

a second transverse bore communicating with said central longitudinal bore for conveying the liquid from said central longitudinal bore to said outlet port;

a longitudinal groove extending between said first transverse bore and said second transverse bore for conveying the liquid therebetween; and an annular groove formed in said central longitudinal bore at a juncture of said central longitudinal bore and said second transverse bore for conveying the liquid from the longitudinal groove around the piston to the second transverse bore, and wherein said pump housing further comprises:

a pump casing having said inlet port and said outlet port; and a liner received within said pump casing, said liner having said central longitudinal bore, said first transverse bore, said second transverse bore, said longitudinal groove and said annular groove, and wherein said longitudinal groove is formed in an outer surface of said liner facing said casing.

* * * * *